US009808828B2

(12) United States Patent
Nabeshima et al.

(10) Patent No.: US 9,808,828 B2
(45) Date of Patent: Nov. 7, 2017

(54) ELECTROSTATIC PAINTING METHOD

(71) Applicant: TOYOTA JIDOSHA KABUSHIKI KAISHA, Toyota-shi, Aichi-ken (JP)

(72) Inventors: Atsuo Nabeshima, Okasaki (JP); Kazuki Tanaka, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/180,371

(22) Filed: Jun. 13, 2016

(65) Prior Publication Data

US 2017/0021384 A1 Jan. 26, 2017

(30) Foreign Application Priority Data

Jul. 21, 2015 (JP) ..... 2015-143941

(51) Int. Cl.
*B05D 1/04* (2006.01)

(52) U.S. Cl.
CPC ..... *B05D 1/045* (2013.01)

(58) Field of Classification Search
None
See application file for complete search history.

(56) References Cited

U.S. PATENT DOCUMENTS 5,830,541 A * 11/1998 Carswell ..... B05D 1/045 427/475
2004/0115359 A1* 6/2004 Cebola ..... B05B 12/00 427/9

FOREIGN PATENT DOCUMENTS

JP 2014-138919 A 7/2014
JP 2014138919 A * 7/2014

* cited by examiner

*Primary Examiner* — Michael P Rodriguez
(74) *Attorney, Agent, or Firm* — Oliff PLC

(57) ABSTRACT

An electrostatic painting method includes steps of: attaching a grounded clip to an insulating workpiece; spraying water-based paint to the workpiece while moving a paint gun from a position where the painting has started in a predetermined direction to form a first band-like painting film; spraying the water-based paint to the workpiece while moving the paint gun to thereby form a second band-like painting film, in which the second band-like painting film is formed in parallel to the first painting film, and a part of the second band-like painting film overlaps the first painting film. An amount of overlap between the first and second painting films is within a range previously determined based on an influence on the water-based paint sprayed when the second painting film is formed that causes the water-based paint sprayed to be attracted to the grounded first painting film.

1 Claim, 6 Drawing Sheets

WHEN FLYING SPEED OF PAINT IS LOW
& MOVING SPEED OF PAINT GUN IS HIGH

WHEN FLYING SPEED OF PAINT IS HIGH
& MOVING SPEED OF PAINT GUN IS LOW

ELECTROSTATIC PAINTING METHOD

CROSS-REFERENCE TO RELATED APPLICATIONS

This application is based upon and claims the benefit of priority from Japanese patent application No. 2015-143941, filed on Jul. 21, 2015, the disclosure of which is incorporated herein in its entirety by reference.

BACKGROUND OF THE INVENTION

1. Field of the Invention

The present invention relates to an electrostatic painting method.

2. Description of Related Art

A method of grounding a workpiece to paint the workpiece has been known as a method for electrostatically painting an insulating workpiece (an object to be painted) with conductive water-based paint. For example, in Japanese Unexamined Patent Application Publication No. 2014-138919, a grounding clip is attached to an insulating workpiece, painting is started in a painting region of the insulating workpiece near the grounding clip, and the workpiece is electrostatically painted in a direction moving away from the grounding clip.

SUMMARY OF THE INVENTION

In the electrostatic painting method disclosed in Japanese Unexamined Patent Application Publication No. 2014-138919, when, for example, a workpiece W is large, a paint gun 1 performs scanning a plurality of times to thereby form a plurality of band-like painting films and electrostatically paint a wide painting region of the workpiece W. The adjacent band-like painting films need to overlap each other to some extent in order to ensure conductivity when the workpiece W is electrostatically painted. The present inventors have found a problem that when an amount of overlap between the adjacent band-like painting films is small, variations in a painting film thickness dramatically increase.

The present invention has been made in light of the above problem, and an object of the present invention is to provide an electrostatic painting method that can prevent an increase in the variations in the painting film thickness.

An exemplary aspect of the present invention is an electrostatic painting method including steps of: attaching a grounded clip to an insulating object to be painted; spraying, by a paint gun, water-based paint to the clip to start electrostatic painting; spraying the water-based paint to the object to be painted while moving the paint gun from a position where the painting has started in a predetermined direction to form a first band-like painting film; spraying the water-based paint to the object to be painted while moving the paint gun to thereby form a second band-like painting film, in which the second band-like painting film is formed in parallel to the first painting film, and a part of the second band-like painting film overlaps with the first painting film. An amount of overlap between the first and second painting films is within a range previously determined based on an influence on the water-based paint sprayed when the second painting film is formed that causes the water-based paint sprayed is formed to be attracted to the grounded first painting film. This prevents the paint sprayed from the paint gun toward the unpainted part of the object to be painted from being attracted to the grounded painting film. Thus, the unpainted part of the object to be painted can be appropriately painted, and consequently, an increase in the variations in the painting film thickness can be reduced.

Widths of the respective first and second painting films are defined by a part having a film thickness of greater than or equal to ½ of a maximum film thickness, and the amount of overlap between the first and second painting films is within a range in which the first and second painting films overlap each other by greater than or equal to ½ of the widths of the first and second painting films. This effectively prevents an increase in the variations in the painting film thickness.

According to the present invention, it is possible to provide an electrostatic painting method that can prevent an increase in variations in a painting film thickness.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Hereinafter, a specific exemplary embodiment incorporating the present invention will be explained in detail with reference to the drawings. However, the present invention is not limited to the following exemplary embodiment. Further, to clarify the explanation, some parts thereof and some of the drawings have been omitted or simplified as appropriate.

First Exemplary Embodiment

Firstly, an electrostatic painting apparatus according to a first exemplary embodiment will be explained by referring to FIG. 1.

Figure 1:
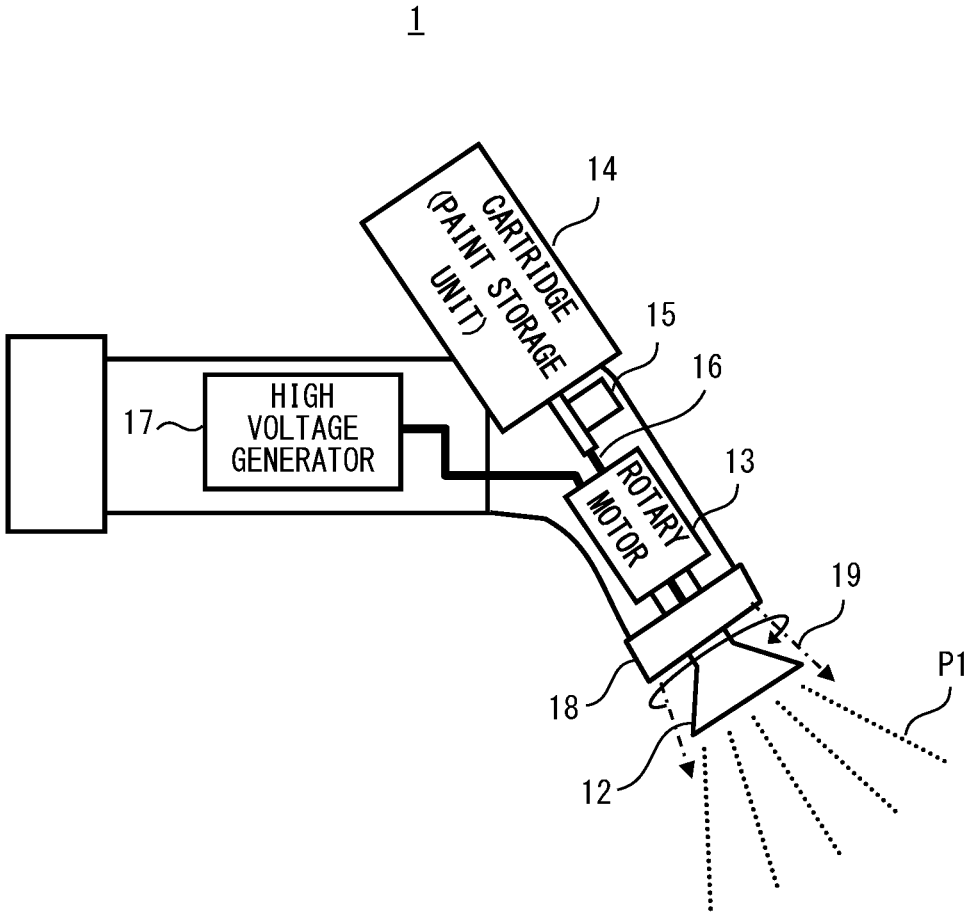
FIG. 1 is a schematic diagram of a paint gun mounted on an electrostatic painting apparatus according to a first exemplary embodiment.

FIG. 1 is a schematic diagram of a paint gun 1 mounted on the electrostatic painting apparatus according to the first exemplary embodiment.

As shown in FIG. 1, the paint gun 1 is a rotary atomizer paint gun and includes a rotary atomizer head 12, a rotary motor 13, a cartridge 14, a trigger valve 15, a tube 16, a high voltage generator 17, and a shaping air ring 18. Note that the paint gun 1 is not limited to a rotary atomizer and may be a paint gun of another system as long as electrostatic painting can be carried out.

Water-based paint P1 used for electrostatic painting is stored in the cartridge 14. The paint P1 is, for example, resinous paint containing water.

The cartridge 14 is connected to the rotary atomizer head 12 with the tube 16 interposed therebetween. Further, the trigger valve 15 is attached to the tube 16. For example, when the trigger valve 15 is opened, the paint P1 stored in the cartridge 14 is supplied to inside the rotary atomizer head 12 through the tube 16, while when the trigger valve 15 is closed, the supply of the paint P1 from the cartridge 14 to the rotary atomizer head 12 is stopped.

The rotary atomizer head 12 has a shape of a bell in which an inner diameter thereof is expanded gradually from a base toward an open end, and a plurality of grooves are formed radially on an inner peripheral surface of the open end. When the rotary atomizer head 12 is rotated using the rotary motor 13 at a high speed, by an influence of centrifugal force, the paint P1 supplied to inside the rotary atomizer head 12 from the cartridge 14 flows along the inner peripheral surface of the open end, reaches the open end, and then the thread-like paint P1 is discharged from the plurality of grooves formed on the inner peripheral surface of the open end.

The shaping air ring 18 is provided to surround the base of the rotary atomizer head 12 and blows out shaping air from a discharge port to an outer peripheral surface of the open end of the rotary atomizer head 12. The shaping air ring 18 blows out the shaping air to the thread-like paint P1 discharged from the rotary atomizer head 12 to thereby atomize the thread-like paint P1 and also forms a painting pattern of the atomized paint P1.

The high voltage generator 17 generates a high voltage and applies it to the paint P1 to thereby charge the paint P1 to a negative polarity. Then, the atomized paint P1 that has been charged to the negative polarity is attracted to a grounded part (which will be described later) of the workpiece W that has been charged to a positive polarity and adhered to around the grounded part. That is, the workpiece W is electrostatically painted.

Next, an electrostatic painting method performed by the electrostatic painting apparatus according to the first exemplary embodiment will be explained.

Figure 2:
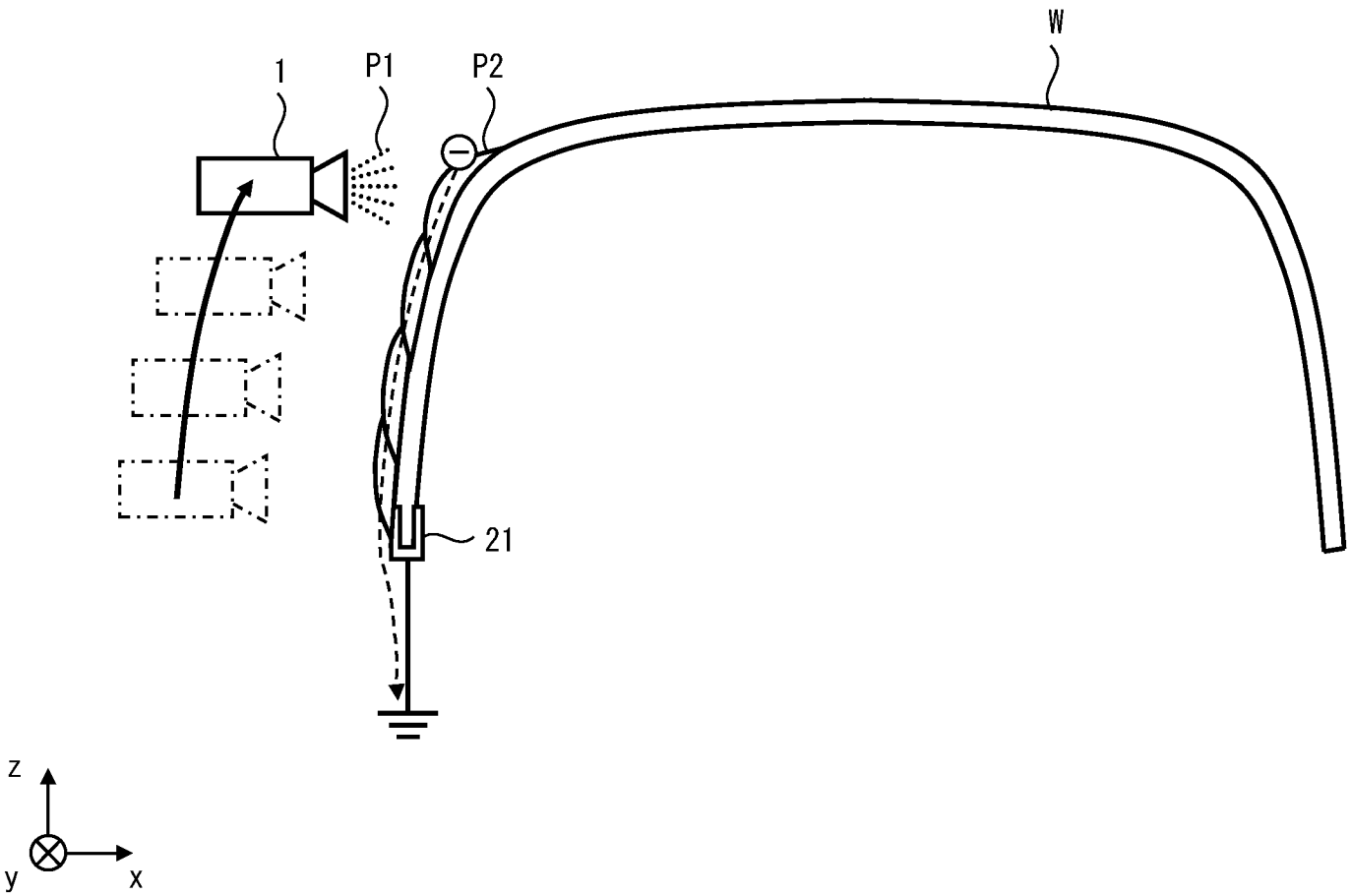
FIG. 2 is a conceptual diagram for explaining a basic electrostatic painting method according to the first exemplary embodiment.
Figure 3:
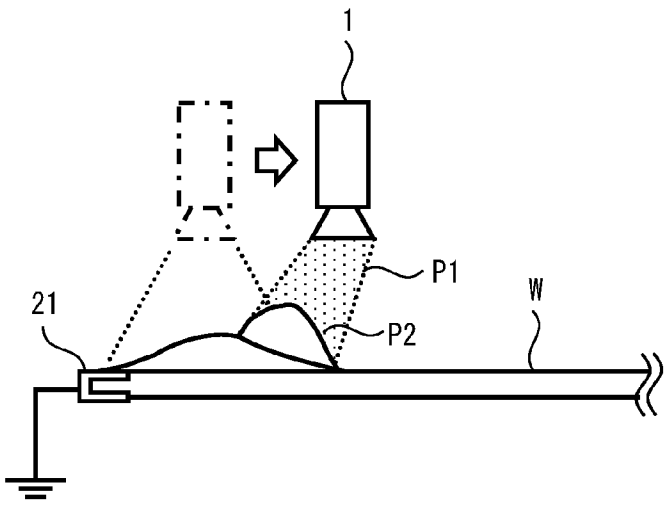
FIG. 3 is a drawing showing a difference in results of electrostatic painting caused by a difference in flying speeds of paint and moving speeds of a paint gun.
Figure 3:
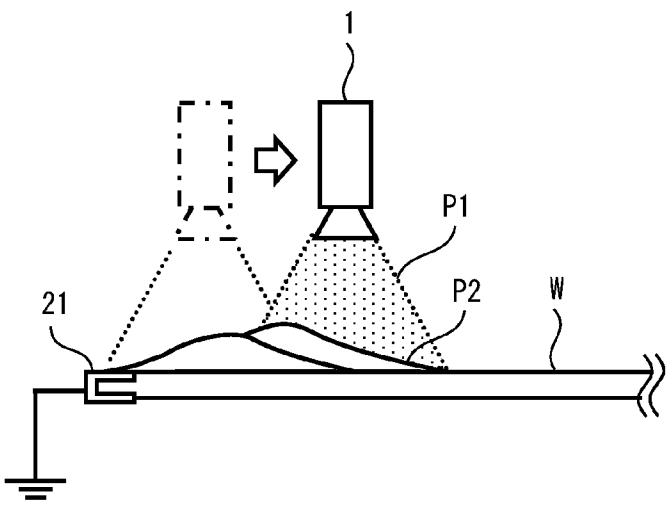
Figure 3:
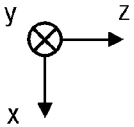
Figure 4:
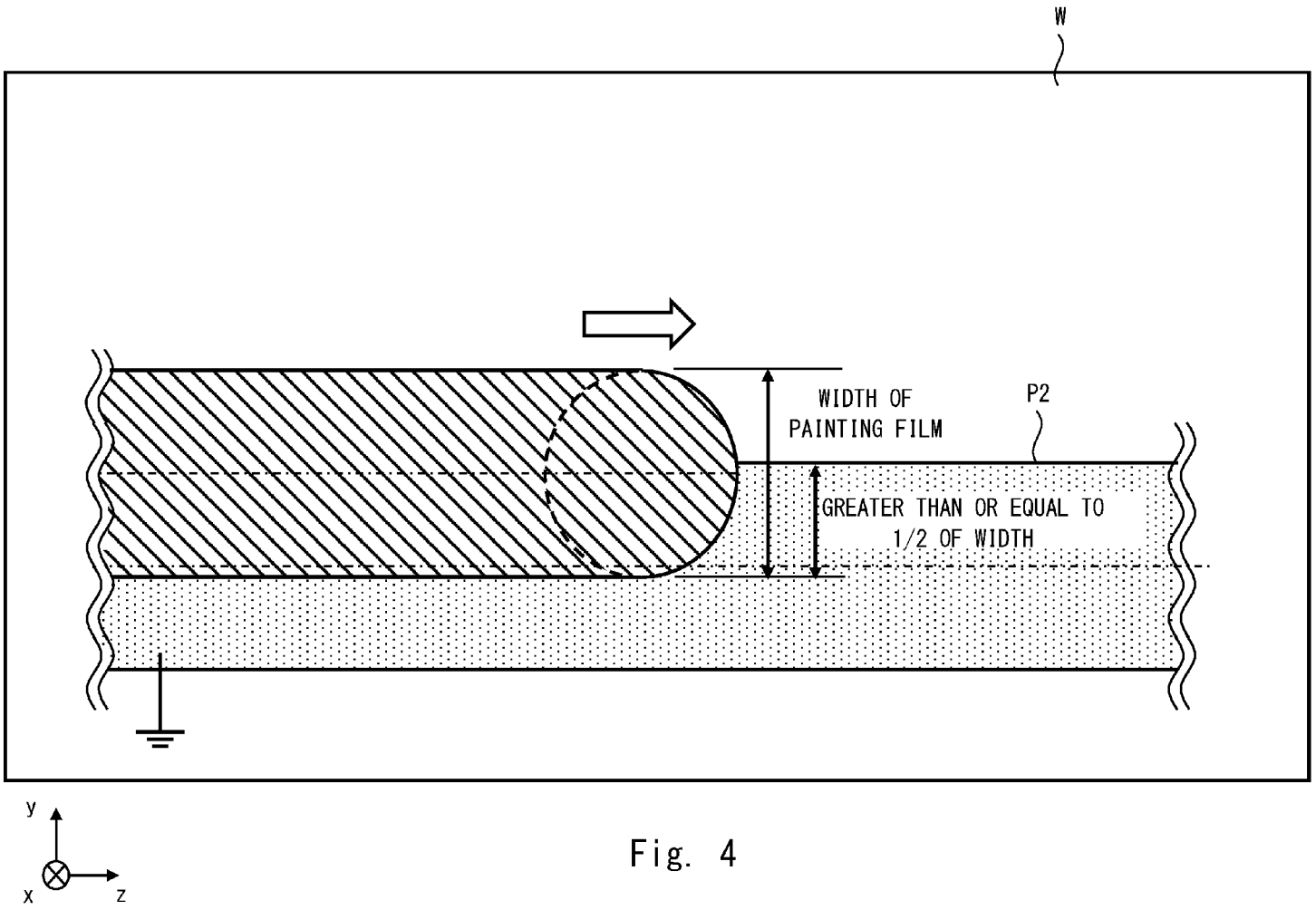
FIG. 4 is a conceptual diagram for explaining an electrostatic painting method when a plurality of band-like painting films are formed.
Figure 5:
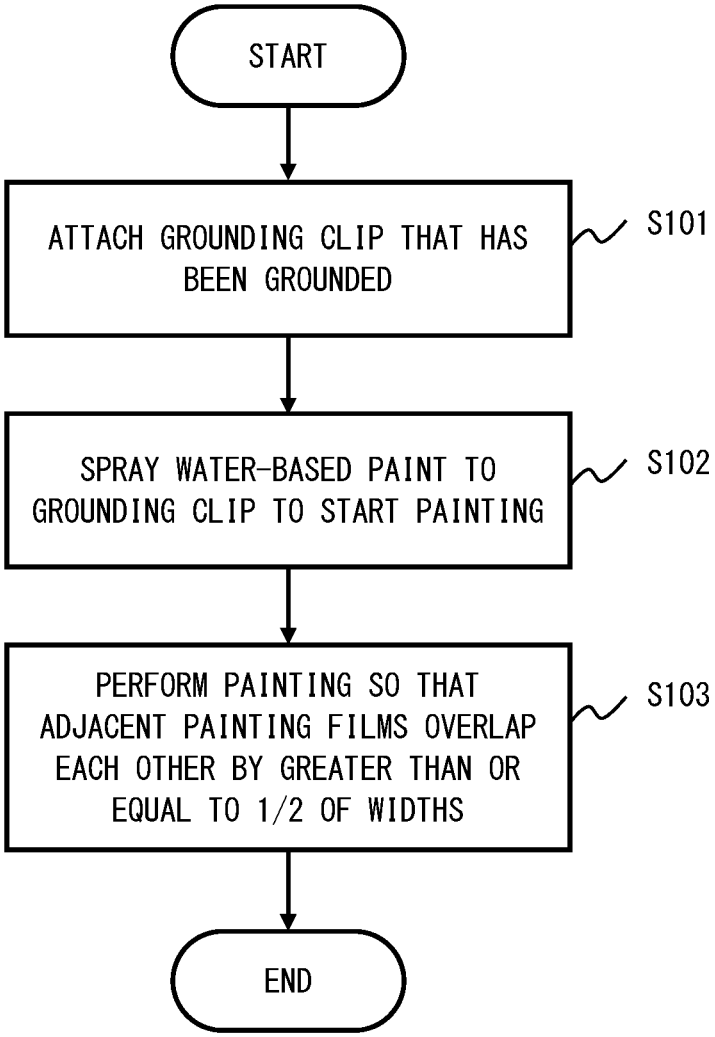
FIG. 5 is a flowchart showing the electrostatic painting method according to the first exemplary embodiment.

FIG. 2 is a conceptual diagram for explaining a basic electrostatic painting method. FIG. 3 is a drawing showing a difference in results of electrostatic painting caused by a difference in flying speeds of the paint and moving speeds of the paint gun. FIG. 4 is a conceptual diagram for explaining an electrostatic painting method when a plurality of band-like painting films are formed. FIG. 5 is a flowchart showing the electrostatic painting method according to the first exemplary embodiment. Note that FIGS. 2 to 4 show a right-hand XYZ coordinate system for convenience in order to explain a positional relationship of components.

In this example, the insulating workpiece (an object to be painted) W such as a resin bumper or the like is electrostatically painted.

As shown in FIG. 2, firstly a grounded grounding clip 21 is attached to the workpiece W (step S101 in FIG. 5). By doing so, it is possible to electrostatically paint a painting region of the insulating workpiece W near the grounding clip 21.

After that, the paint P1 that has been charged to the negative polarity is sprayed from the paint gun 1 to the grounding clip 21 to start the electrostatic painting (step S102 in FIG. 5). Then, a painting film P2 made of the paint P1 is formed in the painting region of the workpiece W near the grounding clip 21.

As the painting film P2 formed in the painting region of the workpiece W near the grounding clip 21 has not been dried yet and contains water, the painting film P2 is conductive. Therefore, the painting film P2 is grounded by the grounding clip 21. The grounding clip 21 and the painting film P2 that are grounded by the grounding clip 21 will also be referred to as the grounded part of the workpiece W.

After that, while the paint gun 1 is moved in a predetermined direction (substantially a z-axis direction in the example of FIG. 2) from a position where the painting has started, the paint P1 is sprayed toward a part of the workpiece W near a boundary between a part where the painting has been completed and an unpainted part. At this time, the paint P1 is applied not only to the grounded part where the painting has been completed but also to the unpainted part (an insulating part) using a force of an electric field formed between the atomized paint P1 that has been charged to the negative polarity and the grounded part where the painting has been completed (the grounded part). The painting film P2 is formed in a band shape by repeating the above processes.

Referring to the right drawing of FIG. 3, when the moving speed of the paint gun 1 is too high, a proportion of the unpainted part (the insulating part) to a target region to be sprayed with the paint P1 will become large. Thus, the paint P1 sprayed toward the unpainted part could be attracted to the grounded part where the painting has been completed, and the unpainted part could not be electrostatically painted as appropriate. As a result, variations in the film thicknesses of the painting film P2 may increase and a painting efficiency may be reduced.

Accordingly, the moving speed of the paint gun 1 should preferably be as low as possible. More specifically, the moving speed of the paint gun 1 is preferably set to less than or equal to 600 mm/sec. By such a setting, as shown in the left drawing of FIG. 3, as the proportion of the unpainted part (the insulating part) to the target region to be sprayed with the paint P1 is small, the influence on the paint P1 that causes the paint P1 sprayed toward the unpainted part to be attracted to the grounded part where the painting has been completed can be reduced, and the unpainted part can be electrostatically painted as appropriate. As a result, the variations in the film thickness of the painting film P2 can be reduced, and the reduction in the painting efficiency can be prevented.

Further, when a flying speed of the paint P1 sprayed from the paint gun 1 is too low, the paint P1 sprayed toward the unpainted part may be attracted to the grounded part where the painting has been completed, and the unpainted part may not be electrostatically painted as appropriate. Consequently, the variations in the film thickness of the painting film P2 may increase, and the painting efficiency may be reduced.

Accordingly, the flying speed of the paint P1 sprayed from the paint gun 1 is preferably as high as possible.

In addition, a distance between the discharge port of the paint gun 1 and the workpiece W is preferably short enough so that the flying speed of the paint P1 can be maintained. To be more specific, the distance between the discharge port of the paint gun 1 and the workpiece W is preferably set to be within a range of about 200 mm to 150 mm. By setting such a range, the influence on the paint P1 that causes the paint P1 sprayed toward the unpainted part of the workpiece W to be attracted to the grounded part where the painting has been completed can be reduced, and the unpainted part can be electrostatically painted as appropriate. As a result, the variations in the film thickness of the painting film P2 can be reduced, and the reduction in the painting efficiency can be prevented.

When, for example, the workpiece W is large, the paint gun 1 performs scanning (is moved) a plurality of times to thereby form a plurality of band-like painting films in parallel and electrostatically paint a wide painting region of the workpiece W. The adjacent band-like painting films need to overlap each other to some extent in order to ensure conductivity when the workpiece is electrostatically painted.

However, when an amount of overlap between the adjacent band-like painting films is small, the proportion of the unpainted part (the insulating part) to the target region to be sprayed with the paint P1 will become large. Therefore, the paint P1 sprayed toward the unpainted part in order to form the band-like painting film is attracted to the grounded band-like painting film that has been previously formed, and thus the unpainted part may not be electrostatically painted as appropriate. As a result, the variations in the film thickness of the painting film P2 may increase.

For example, when the amount of overlap is reduced to a minimum in order to reduce the number of times the paint gun 1 performs scanning, the above problem is likely to occur.

For this reason, in this exemplary embodiment, the amount of overlap between the adjacent band-like painting films is set within such a predetermined range that the paint P1 sprayed toward the unpainted part in order to form the band-like painting film will not be attracted to the grounded band-like painting film that has been previously formed (or set within such a predetermined range that a force of attraction becomes ignorable) (step S103 in FIG. 5). In other words, the amount of overlap is set within a predetermined range based on the influence on the paint P1 that causes the paint P1 sprayed toward the unpainted part to be attracted to the band-like painting film that has been previously formed.

More specifically, the amount of overlap between the adjacent band-like painting films is preferably set within such a range that, as shown in FIG. 5, the adjacent band-like painting films overlap each other by greater than or equal to ½ of respective widths of the painting films in a width direction (a y-axis direction in the example of FIG. 5). Note that the widths of the respective painting films are defined by a part having a film thickness of greater than or equal to ½ of a maximum film thickness.

By doing so, the proportion of the unpainted part (the insulating part) to the target region to be sprayed with the paint P1 will become small. It is therefore possible to reduce the influence on the paint P1 that causes the paint P1 sprayed toward the unpainted part in order to form the band-like painting film to be attracted to the grounded band-like painting film that has been previously formed, and the unpainted part can be electrostatically painted as appropriate. This consequently reduces the variations in the film thickness of the painting film P2. Further, the painting efficiency is improved.

Figure 6:
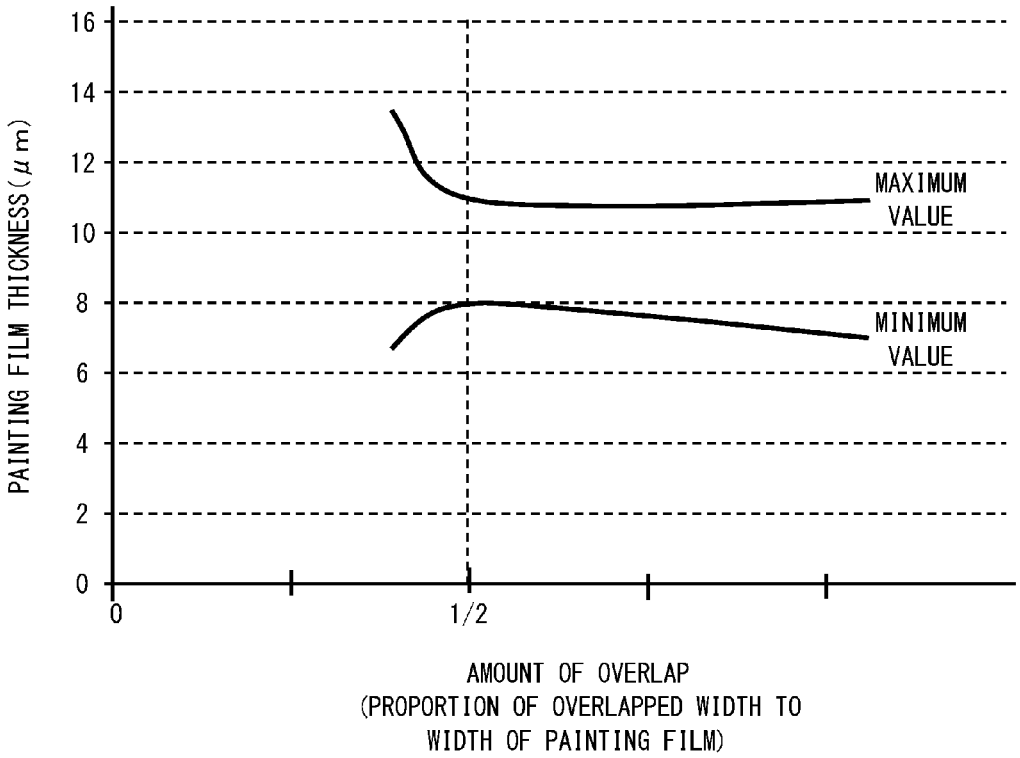
FIG. 6 shows a result of an experiment in which a relationship between an amount of overlap between adjacent band-like painting films and a painting film thickness is indicated.

The inventors have conducted an experiment on a relationship between the amount of overlap between the adjacent band-like painting films and the painting film thickness. A result of the experiment will be explained below. FIG. 6 shows the result of the experiment on the relationship between the amount of overlap between the adjacent band-like painting films and the painting film thickness. Note that the amount of overlap indicated by the horizontal axis is expressed by a proportion of an overlapped width to a width of the band-like painting film. Experiment conditions are: the number of rotations of the rotary atomizer head 12 is 20000 rmp; a voltage applied to the rotary atomizer head 12 is −80 kV; and a moving speed of the paint gun 1 is 500 mm/sec.

As shown in FIG. 6, when the adjacent band-like painting films overlap each other by less than ½ of the respective widths of the painting films, variations in the painting film thickness are large. On the other hand, when the adjacent band-like painting films overlap each other by greater than or equal to ½ of the respective widths of the painting films, the variations in the painting film thickness are small. It can be seen from the above that the amount of overlap between the adjacent band-like painting films is preferably within a range in which the adjacent band-like painting films overlap each other by greater than or equal to ½ of the widths of the painting films.

As described above, in the electrostatic painting method according to the first exemplary embodiment, the amount of overlap between the adjacent painting films is set within such a predetermined range that the paint P1 sprayed toward the unpainted part in order to form the band-like painting film will not be attracted to the grounded band-like painting film that has been previously formed (or set within such a predetermined range that a force of attraction becomes ignorable). This prevents the paint sprayed from the paint gun 1 toward the unpainted part of the workpiece W from being attracted to the grounded painting film. Thus, the unpainted part of the workpiece W can be appropriately painted, and consequently, an increase in the variations in the painting film thickness can be prevented.

Note that the present invention is not limited to the above-described exemplary embodiment, and modifications can be made as appropriate without departing from the scope thereof.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electrostatic painting method comprising steps of:

attaching a grounded clip to an insulating object to be painted;

spraying, by a paint gun, water-based paint to the clip to start electrostatic painting;

spraying the water-based paint to the object to be painted while moving the paint gun from a position where the painting has started in a predetermined direction to form a first band-like painting film;

spraying the water-based paint to the object to be painted while moving the paint gun to thereby form a second band-like painting film, the second band-like painting film being formed in parallel to the first painting film, and a part of the second band-like painting film overlapping the first painting film, wherein an amount of overlap between the first and second painting films is within a range in which the first and second painting films overlap each other by greater than or equal to ½ of the widths of the first and second painting films.

* * * * *